United States Patent [19]

Streeper et al.

[11] Patent Number: 4,566,154

[45] Date of Patent: Jan. 28, 1986

[54] NONWOVEN WEB SPREADER

[75] Inventors: Leonard W. Streeper, Minotola; Joseph R. Chille, Collingslake, both of N.J.

[73] Assignee: Scott Paper Company, Philadelphia, Pa.

[21] Appl. No.: 519,635

[22] Filed: Aug. 2, 1983

[51] Int. Cl.[4] ..... D01G 25/00; D06C 3/06

[52] U.S. Cl. ..... 19/296; 19/161.1; 26/101; 26/103

[58] Field of Search ..... 19/296, 161.1, 163, 19/299, 236, 258; 425/83.1; 156/62.8, 496, 324; 26/87, 101, 102, 103, 99

[56] References Cited

U.S. PATENT DOCUMENTS

| | | | |
|---|---|---|---|
| 1,814,652 | 7/1931 | Weiss | 26/103 |
| 2,594,591 | 4/1952 | Runton | 19/296 X |
| 2,626,422 | 1/1953 | Lammertse | 26/101 X |
| 3,330,456 | 7/1967 | Umstott | 26/101 X |
| 3,708,831 | 1/1973 | Burger | 19/161.1 X |
| 3,772,107 | 11/1973 | Gentile et al. | 156/62.8 |
| 3,874,030 | 4/1975 | Knight | 26/101 X |
| 3,907,186 | 9/1975 | Hasler | 26/102 X |
| 3,940,216 | 2/1976 | Hinckley | 425/81.1 |
| 4,315,965 | 2/1982 | Mason et al. | 428/198 |

FOREIGN PATENT DOCUMENTS

| | | | |
|---|---|---|---|
| 527954 | 6/1931 | Fed. Rep. of Germany | 26/103 |
| 1177655 | 4/1959 | France | 26/101 |
| 351656 | 7/1931 | United Kingdom | 26/103 |

*Primary Examiner*—Louis K. Rimrodt
*Assistant Examiner*—J. L. K. Olds
*Attorney, Agent, or Firm*—Joseph H. Yamaoka; John W. Kane, Jr.

[57] ABSTRACT

A web spreading apparatus that includes a set of spreader rolls spaced from each other in the machine direction of web formation with the axles of the rolls extending generally in the cross-machine direction of web formation. The set of spreader rolls includes a first upstream group of curved rolls and a second downstream group of rolls. Each roll in the downstream group has a central region having less curvature than the end regions joining the central region.

8 Claims, 2 Drawing Figures

NONWOVEN WEB SPREADER

TECHNICAL FIELD

This invention relates in general to a machine for forming a nonwoven fibrous web, and in particular to a section of the machine that reorients and spreads fibers in the formed web so as to increase the length of the web in the cross-machine direction.

BACKGROUND ART

The use of carding machines for forming nonwoven webs of staple length fibers, oriented in the machine direction of web formation, are well known in the prior art. It is also known in the prior art to employ a fiber orienting and web spreading apparatus after the carding machines for the purpose of increasing the length of the formed web in the cross-machine direction of formation. The use of a fiber orienting and web spreading apparatus in conjunction with a carding machine is described in U.S. Pat. No. 3,772,107—Gentile, et al and in U.S. Pat. No. 3,940,216—Hinckley, both patents being assigned to the assignee of the present invention.

As disclosed in the above-mentioned patents to Gentile, et al and Hinckley, the web spreading and fiber reorienting section consists of a plurality of curved spreader rolls spaced from each other in the machine direction of web formation with their axles extending generally in the cross-machine direction of web formation. Typically, the web spreading section includes a set of about 12 spreader rolls. In one prior art configuration, the centerline of each spreader roll is a segment of a circle, each circle having the same radius of curvature. In another prior art configuration, the set of spreader rolls is broken down into groups of either 3 or 4 spreader rolls. The centerlines of the spreader rolls within a group are segments of a circle having the same radius of curvature, but the radius of curvature for each group of spreader rolls further downstream in the machine direction is greater than the radius of curvature of the preceding upstream group of spreader rolls.

With the prior art curved spreader rolls, the cross-machine width of the web coming out of a cardline is typically increased by about 45% at the commercial operating speed of web formation. Attempts to increase either the web formation speed or the amount of cross-machine spreading results in basis weight variations across the formed web that are not commercially acceptable. In particular, the basis weight of the central portion of the spread web is less than the basis weight of the edge portions of the spread web. Since the formed web is usually manufactured to meet a specified minimum basis weight, the extra basis weight at the end portions of the web represents an inefficiency in the manufacturing process.

It is believed that the basis weight variation caused by the prior art spreading sections is due to a combination of over-spreading in the central portion of the web and a "necking down," or lateral displacement of fibers toward the center of the web, as the formed web leaves the spreading section. Since the fibers at the edge of the formed web undergo a larger lateral displacement than the fibers at the central portion of the web, the necking down phenomenon also increases the basis weight of the edge portion of the formed web in comparison to the central portion of the web.

It is also known in the prior art to employ within a set of spreader rolls a single roll having a centrally located straight section to provide limited arresting of the spreading of fibers in the web.

It is, therefore, an object of this invention to provide an improved web spreading apparatus for use in the manufacture of nonwoven webs.

It is another object of this invention to provide a web spreading apparatus that results in a more even basis weight distribution across the width of a formed web.

It is yet another object of this invention to provide a web spreading apparatus that results in a more even basis weight distribution across the width of a formed web while increasing the length the web is spread in the cross-machine direction when compared to prior art spreaders.

DISCLOSURE OF INVENTION

This invention is directed to a web spreading apparatus that includes a set of spreader rolls spaced from each other in the machine direction of web formation with the axles of the rolls extending generally in the cross-machine direction of web formation. The set of spreader rolls includes a first upstream group of curved rolls and a second downstream group of rolls. Each roll in the downstream group has a central region having less curvature than the end regions joining the central region, with the result that the central region of each roll gradually reduces or if the central region is flat arrests the outward spreading of fibers, thereby stabilizing the density of the central region of the web. The curved end regions of each downstream roll continue to spread the fibers in the end regions of the web so as to continue to increase the overall width of the web.

In one preferred embodiment, the length of each central region is less than the length of the central region of the adjacent downstream roll.

In another preferred embodiment of this invention, the central region of each roll in the downstream group is straight so as to virtually arrest spreading of the fibers engaged by the central region.

It is also preferred that the length of the central region of the most downstream roll in the set is at least equal to the width of the spread web passing over said most downstream roll. As a result of this arrangement the fibers passing over the most downstream roll tend to be moving virtually parallel to the machine direction of web travel, thereby minimizing "necking-in" of the web and the resulting basis weight variation.

In another aspect of this invention, the curved upstream group of rolls are in the shape of concentric circular segments. Although not essential to the invention, this arrangement tends to maintain a uniform cross directional movement of fibers, and helps to control spreading of the fibers prior to reaching the downstream group of rolls. It is also preferred that the curved end regions of the downstream group of spreader rolls also have the shape of concentric circular segments.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
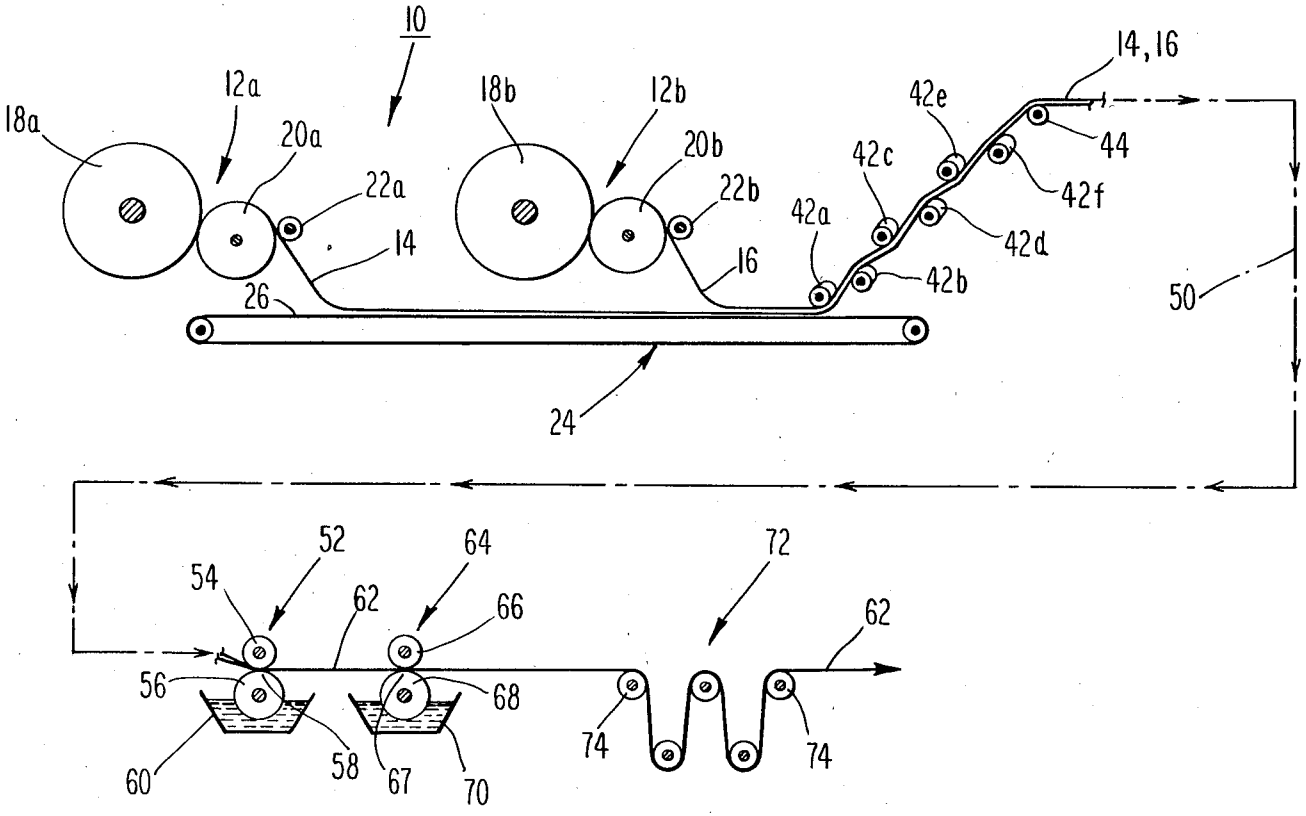
FIG. 1 is a schematic elevational view showing a machine for forming a nonwoven fibrous web in which the present invention can be employed.

FIG. 1 is a schematic representation of a machine 10 that manufactures a nonwoven fibrous web and which includes the fiber reorienting and web spreading apparatus of this invention. The machine 10 includes conventional lap forming means, such as carding sections 12*a*, 12*b*, for forming laps 14 and 16 of loosely associated staple fibers, the major proportion of which are predominately oriented in the machine direction of lap formation. Each carding section 12*a*, 12*b* includes a carding roll 18*a*, 18*b* having a plurality of pins or wire points (not shown) disposed about the periphery thereof for combing fibers from a feed mat of staple fibers to orient a major proportion of said fibers substantially in the machine direction. In addition, each carding section 12*a*, 12*b* includes a doffing roll 20*a*, 20*b* for collecting and removing the oriented fibers from the carding roll 18*a*, 18*b* in the form of a fibrous lap 14, 16. Lap 14, 16 removing means 22*a*, 22*b*, such as that sold under the trademark "Doffmaster" by John D. Hollingsworth on Wheels, Inc. of Greenville, S.C., is disposed adjacent to the doffing roll 20*a*, 20*b* of each carding section 12*a*, 12*b* for removing the laps 14, 16 from the doffing roll 20*a*, 20*b* and for directing said laps 14, 16 into overlying relationship onto an upper horizontal delivery run 26 of an air impervious continuous conveyor belt 24.

As shown in FIG. 1, lap 16 formed in carding section 12*b* overlies the lap 14 formed in carding section 12*a*. The overlying laps 14, 16 are then conveyed to the spreader section 40 of the machine 10. As shown in FIG. 1, the spreader section 40 includes a plurality of spreader rolls 42*a*–42*f* which reorient and spread the fibers so that the width of the laps 14, 16 leaving the spreader section 40 is longer than the width of the laps 14, 16 entering the spreader section 40. After the spread laps 14, 16 leave the spreader section 40, they pass over a straight guide roll 44, and as indicated by dashed line 50, the spread laps 14, 16 are conveyed to subsequent sections of machine 10 where strength is added to the combined spread laps 14, 16. One typical method of adding strength to the formed laps 14, 16, and which is illustrated in FIG. 1, is to adhesively bond the laps 14, 16 in a pattern. Thus, the laps 14, 16 are conveyed to a wet calender section 52 of the machine 10 which includes opposed driven rolls 54 and 56 defining a nip 58 therebetween. The lower roll 56 passes through a wetting solution 60, and conveys the wetting solution 60 to the nip 58 to accomplish wet pressing of the laps 14, 16 in the nip 58 to form a unitary nonwoven fibrous web 62. The nonwoven fibrous web 62 is then directed through a bonding section 64 consisting of a back-up roll 66 and a printing roll 68 defining a nip 67 therebetween. The printing roll 68 passes through an adhesive solution 70, and conveys the solution 70 into the nip 67 to bond fibers together in the unitary nonwoven fibrous web 62. Preferably, the printing roll 72 is patterned to pick up adhesive 70 in discrete patterns to thereby form discrete bonded areas in the nonwoven fibrous web 62. Upon leaving the bonding section of machine 10, the adhesively bonded nonwoven web 62 is conveyed to a dryer section 72 which typically consists of a plurality of driven can dryers 74. The dryers 74 remove moisture from the web and also sets and/or cures the adhesive material. The dried nonwoven web material 62 is then conveyed from dryers 74 to a reel section of the machine (not shown) where it is wound into a supply roll (not shown) for storage and subsequent use.

The above description of a machine 10 for manufacturing a nonwoven web material is abbreviated because such machines are well known to those skilled in the art. A more detailed description of such a machine 10 can be found in the aforementioned patents to Gentile et al and Hinckley. It will also be apparent to those skilled in the art that although the web forming machine 10 of FIG. 1 accomplishes strengthening of the formed web by using adhesive bonds, the strengthening can also be obtained by thermally bonding the nonwoven web 62 as described in U.S. Pat. No. 4,315,965—Mason et al, assigned to the assignee of the present invention.

Figure 2:
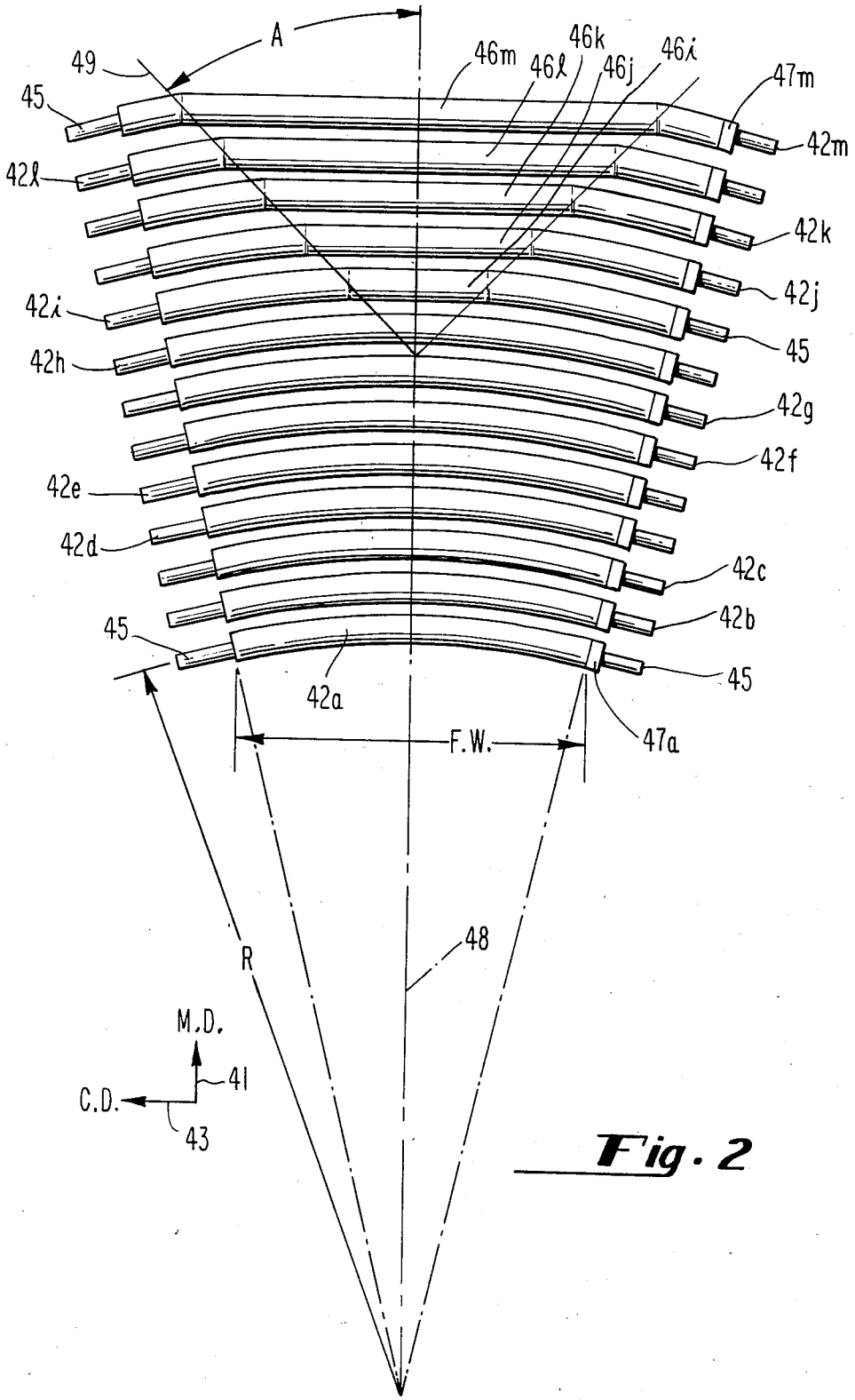
FIG. 2 is a plan view of a preferred embodiment of the web spreading device of this invention which can be used in the machine shown in FIG. 1.

One preferred embodiment of an improved spreading section 40 in accordance with this invention is illustrated in FIG. 2. The spreading section 40 includes 13 spreader rolls 42*a*–42*m*. The spreader rolls 42*a*–42*m* are spaced from each other in the machine-direction as represented by arrow 41 and have axles 45 extending generally in the cross-machine direction of web formation as indicated by arrow 43. Each spreader roll 42 has at one end thereof means, such as a timing pulley 47, for rotating the spreader roll 42. As shown in FIG. 2, spreader roll 42*a* is the most upstream roll in the machine 10 and spreader 42*m* is the farthest downstream roll in the machine 10. The first eight spreader rolls 42*a*–42*h* form an upstream group of spreader rolls and are curved rolls. The last five spreader rolls 42*i*–42*m* form a downstream group of spreader rolls with each roll having a central region 46*i*–46*m* which has less curvature than its opposed end regions. By less curvature is meant that the shape of the central regions 46*i*–46*m* of spreader rolls 42*i*–42*m* could have a constant curvature, or could have a varying curvature that decreases to a minimum value at the center line 48 of spreader section 40, or as depicted in FIG. 2, is a straight section. Because of the shape of the downstream rolls 42*h*–42*m*, each roll in the downstream group provides no more spreading of the web than does its adjacent upstream roll, and in the preferred embodiment, each roll in the downstream group provides less spreading of the web than is provided by its adjacent upstream roll.

As shown in FIG. 2, spreaders 42*a*–42*h* are curved along their entire length and have a constant curvature, that is to say that the center line of each spreader roll 42*a*–42*h* has the shape of a segment of a circle. In a preferred embodiment, the spreader rolls 42*a*–42*h* have a common center, that is they are concentric. It is also preferred that the opposed end regions of spreader rolls 42*i*–42*m* also have a constant curvature and are concentric with spreader rolls 42*a*–42*h*. In the embodiment depicted in FIG. 2, the center line of each downstream spreader roll 42*i*–42*m* is a segment of a circle at one end region of the roll, then becomes a straight line in the central region of the roll and then again becomes a segment of a circle at the other end of the roll. One approach for defining the length of center regions 46*i*–46*m* of spreader rolls 42*i*–42*m* is to locate the transition points of the roll center lines, that is the point where the center line changes from a curve to a straight line, along a straight line 49 which makes a fixed angle A with the center line 48 of spreader section 40. This results in the length of the straight region **46*i*–46*m* in the downstream group of spreader rolls 42*i*–42*m* progressively increasing in the downstream direction of web formation. It is furthermore preferred that the length of the central region 46*m* of the farthest downstream spreader roll 42*m* be greater than the width of the spread web passing over spreader roll 42*m* and that the central region 46*m* completely underlie the spread web 62 so that substantially all of the fibers in the spread web 62 will be directed in a direction parallel to the machine direction of web formation as the web leaves the last spreader roll 42*m***.

Table I below describes the dimensions of a spreader section 40 that has been built and is operational. The spreader section 40 includes 13 spreader rolls 42. Each of the first eight spreader rolls **42*a*–42*h* are curved and are concentric circular segments. The last five spreader rolls 42*i*–42*m* have curved end regions that are concentric circular segments and substantially straight central regions 46*i*–46*m*. The diameter of all thirteen spreader rolls 42*a*–42*m* at the curved end regions of the rolls 42 is 4.50 inches. The transition points of the center lines of spreader rolls 42*i*–42*m* lie upon a line 49 that makes an angle of 45° with the center line 48 of the spreader section 40. As used in Table I, the Radius, R in FIG. 2, is the distance from the common center to the center line of a curved region of spreader rolls 42*a*–42*m*; the FLAT LENGTH is the length measured in the cross-machine direction of web formation of the straight portion of spreader rolls 42*h*–42*m*; and FACE WIDTH, F.W. in FIG. 2, is the length as measured in the cross-machine direction of web formation, between the center line at one end of spreader roll 42 and the point at the other end of spreader roll 42 where the center line intersects the timing pulley 47**.

TABLE 1

| ROLL | RADIUS | FLAT LENGTH | FACE WIDTH (F.W.) |
|---|---|---|---|
| 42a | 117.87 | — | 55.03 |
| 42b | 124.25 | — | 58.01 |
| 42c | 130.62 | — | 60.99 |
| 42d | 137.00 | — | 63.91 |
| 42e | 143.37 | — | 66.94 |
| 42f | 149.75 | — | 69.92 |
| 42g | 156.12 | — | 72.89 |
| 42h | 162.50 | — | 75.87 |
| 42i | 169.22 | 22.00 | 79.00 |
| 42j | 176.11 | 34.74 | 82.22 |
| 42k | 183.16 | 47.49 | 85.52 |
| 42l | 190.40 | 60.23 | 88.89 |
| 42m | 197.77 | 73.00 | 92.33 |

While the present invention has been described with reference to a specific embodiment thereof, it will be obvious to those skilled in the art that various changes and modifications may be made without departing from the invention in its broader aspects.

It is contemplated in the appended claims to cover all variations and modifications of the invention which come within the true spirit and scope of the invention.

What is claimed is:

1. For use in an apparatus for forming a nonwoven fibrous web, an improved web spreading device comprising a set of spreader rolls, spaced from each other in a machine direction of web formation and having axles extending generally in a cross-machine direction of web formation, characterized in that the spreader rolls comprise an upstream group of curved rolls and a downstream group of rolls, each roll in the downstream group having a straight central region and opposed curved end regions, the length of each central region being less than or equal to the length of the central region of its adjacent downstream spreader roll whereby fibers that have passed over a straight central region are not subjected to further spreading by a more downstream roll.

2. The improved web spreading device of claim 1 wherein the length of the central region of the most downstream roll is at least equal to the width of the spread web passing over said most downstream roll.

3. The improved web spreading device of claim 1 characterized in that the length of each central region is less than the length of the central region of its adjacent downstream spreader roll.

4. The improved web spreading device of claim 2 wherein the length of the central region of the most downstream roll is at least equal to the width of the spread web passing over said most downstream roll.

5. The improved web spreading device of claim 1 wherein the curved upstream rolls and the curved end regions of the downstream rolls are concentric circular segments.

6. The improved web spreading device of claim 2 wherein the curved upstream rolls and the curved end regions of the downstream rolls are concentric circular segments.

7. The improved web spreading device of claim 3 wherein the curved upstream rolls and the curved end regions of the downstream rolls are concentric circular segments.

8. The improved web spreading device of claim 4 wherein the curved upstream rolls and the curved end regions of the downstream rolls are concentric circular segments.

* * * * *